US008192085B2

(12) United States Patent
Pawloski et al.

(10) Patent No.: US 8,192,085 B2
(45) Date of Patent: Jun. 5, 2012

(54) ENHANCEMENT TO A CLOSURE MECHANISM FOR A RECLOSABLE POUCH AND A METHOD OF OPENING SAME

(75) Inventors: James C. Pawloski, Bay City, MI (US); David W. Gustafson, Midland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 323 days.

(21) Appl. No.: 12/544,866

(22) Filed: Aug. 20, 2009

(65) Prior Publication Data

US 2011/0044565 A1 Feb. 24, 2011

(51) Int. Cl.
*B65D 33/16* (2006.01)
*B65D 33/00* (2006.01)

(52) U.S. Cl. ..... 383/65; 383/63; 383/35

(58) Field of Classification Search ..... 383/65, 383/63, 35; 24/399, 400, 585.12
See application file for complete search history.

(56) References Cited

U.S. PATENT DOCUMENTS

| | | | | |
|---|---|---|---|---|
| 5,184,896 | A | 2/1993 | Hammond et al. | |
| 5,259,904 | A | 11/1993 | Ausnit | |
| 5,382,094 | A | 1/1995 | Ausnit | |
| 6,110,091 | A * | 8/2000 | Morano | 493/223 |
| 6,386,762 | B1 | 5/2002 | Randall et al. | |
| 6,594,872 | B2 * | 7/2003 | Cisek | 24/401 |
| 6,959,826 | B2 * | 11/2005 | Knuth et al. | 215/11.1 |
| 6,962,439 | B2 | 11/2005 | Taheri | |
| 7,073,674 | B2 * | 7/2006 | Knuth et al. | 215/11.3 |
| 7,334,682 | B2 | 2/2008 | Goepfert | |
| 7,410,298 | B2 | 8/2008 | Pawloski | |
| 2004/0074799 | A1 * | 4/2004 | Bell et al. | 206/459.1 |
| 2005/0276524 | A1 | 12/2005 | Taheri | |
| 2005/0281489 | A1 * | 12/2005 | Yeh et al. | 383/35 |
| 2008/0137995 | A1 | 6/2008 | Fraser et al. | |
| 2008/0285897 | A1 | 11/2008 | Taheri | |
| 2009/0097782 | A1 * | 4/2009 | Anzini et al. | 383/63 |
| 2009/0232422 | A1 | 9/2009 | Broering et al. | |
| 2010/0303390 | A1 * | 12/2010 | Ackerman et al. | 383/61.2 |
| 2011/0044566 | A1 * | 2/2011 | Fish et al. | 383/63 |

FOREIGN PATENT DOCUMENTS

| | | | |
|---|---|---|---|
| EP | 89680 | A2 * | 9/1983 |
| JP | 2005126071 | A * | 5/2005 |

* cited by examiner

*Primary Examiner* — Jes F Pascua

(57) ABSTRACT

An enhancement to a closure mechanism includes at least one flange that extends upwardly from an interlocking member of the closure mechanism. A line of transverse indentations is formed into the flange parallel to the interlocking member.

20 Claims, 2 Drawing Sheets

ENHANCEMENT TO A CLOSURE MECHANISM FOR A RECLOSABLE POUCH AND A METHOD OF OPENING SAME

CROSS REFERENCE TO RELATED APPLICATIONS

Not applicable.

REFERENCE REGARDING FEDERALLY SPONSORED RESEARCH OR DEVELOPMENT

Not applicable

SEQUENTIAL LISTING

Not applicable

FIELD OF THE INVENTION

The present invention relates to an enhanced closure mechanism for a thermoplastic pouch.

BACKGROUND

A reclosable thermoplastic pouch can be used to store a wide variety of contents, including liquid contents that can contaminate a closure mechanism disposed across an opening of the pouch. The environment in which the reclosable pouch is stored can also contribute to such contamination, which can cause the closure mechanism to become slick, slimy, or otherwise hard for a user to handle. In the past, there have been attempts to provide a gripping aid for a closure mechanism on a pouch to make it easier for a user to manipulate the closure mechanism when it is contaminated.

One such closure mechanism includes one or more ridges of material extending away from a surface thereof and running parallel to the length of the closure mechanism. Each ridge provides for an improved grasp by a user's finger in a direction perpendicular to the ridge. However, such a ridge provides little or no improvement of a user's grasp parallel thereto, especially when the closure mechanism is contaminated and slippery.

Another closure mechanism has a tamper evident tear away portion that seals a mouth of the pouch. Closure profiles are disposed on opposing interior surfaces of first and second pouch walls below the tear away portion. Exterior surfaces of the tear away portion include a line of cross-hatched embossing running parallel to the closure profiles to facilitate a user's grasp of the tear away portion. However, the cross-hatched embossing does not provide any benefit to the user after the tear away portion has been removed from the pouch. A line of perforation or scoring across a bottom of the tear away portion facilitates removal of the tear away portion from the pouch. The pouch also includes raised ridges on interior surfaces of the first and second pouch walls between the line of perforation and the closure profiles.

A further thermoplastic pouch is manufactured from wall material that is deeply embossed with rows of deformations. However, the pouch does not include a closure mechanism, but rather includes a drawstring that is disposed through a hem around a mouth of the pouch. The rows of deeply embossed deformations do not provide any help to a user trying to open the pouch.

The inventors of the present invention have identified that it would be desirable to provide a reclosable thermoplastic pouch with a closure mechanism that is enhanced in such a manner to improve the user's grasp on lips of the pouch to make it easier to open the closure mechanism. It is desirable that such an enhancement helps prevent a user's fingers from slipping in directions both perpendicular and parallel to the closure mechanism. It is further desirable that the enhanced closure mechanism is easy to manufacture, yet can provide an airtight seal.

SUMMARY

In one aspect of the present invention, an enhancement to a closure mechanism is disclosed. The closure mechanism includes a first interlocking member having an elongate profile projecting from an interior surface of the closure mechanism and extending longitudinally between opposite ends of the closure mechanism and a first flange having an elongate profile projecting upwardly from the interlocking member and extending between opposite ends of the closure mechanism. The enhancement includes a first line of transverse indentations formed into an interior surface of the first flange, wherein the first line is substantially parallel to the first interlocking member.

In another aspect of the present invention, a reclosable pouch includes a closure mechanism having first and second elongate resealable members disposed longitudinally across opposing interior surfaces a mouth of the pouch. A flange extends transversely upwardly from the first interlocking member away from an interior of the pouch. A line of transverse indentations is formed into an interior surface of the flange, wherein the line is substantially parallel to the first interlocking member.

In a further aspect of the present invention, a method of opening a resealable closure mechanism on a pouch includes the steps of providing a pouch comprising a closure mechanism having first and second interlocking members having an elongate profile disposed longitudinally across a mouth of the pouch, a first flange extending transversely upwardly from the first interlocking member, a second flange extending transversely upwardly from the second interlocking member, and a line of transverse indentations formed into an interior surface of the first flange, wherein the line is substantially parallel to the first interlocking member. The method further includes the steps of grasping the first flange with a first hand at the line of transverse indentations, grasping the second flange with a second hand, and pulling the first flange away from the second flange to forcibly separate the first and second interlocking members.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

Figure 1:
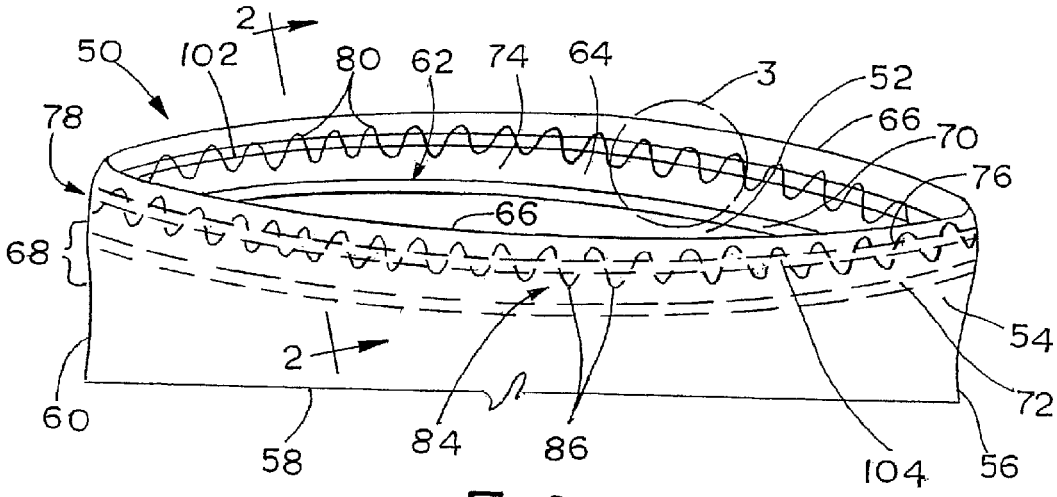
FIG. 1 is an isometric view of a pouch having an enhanced closure mechanism according to one aspect of the invention.

FIG. 1 illustrates a reclosable thermoplastic pouch 50 having a first sidewall 52 and a second sidewall 54 that are connected by, for example, folding, heat sealing, and/or an adhesive, along three peripheral edges 56, 58, 60 to define an interior space 62 between the first and second sidewalls 52, 54 and a mouth 64 along a top edge 66 where the first and second sidewalls 52, 54 are not permanently connected so as to allow access to the interior space 62. An extruded thermoplastic closure mechanism 68 is disposed along the first and second sidewalls 52, 54 across the mouth 64 extending between the peripheral edge 56 and the peripheral edge 60 of the pouch 50 to allow the mouth 64 to be occluded, thereby sealing the mouth 64.

Figure 2A:
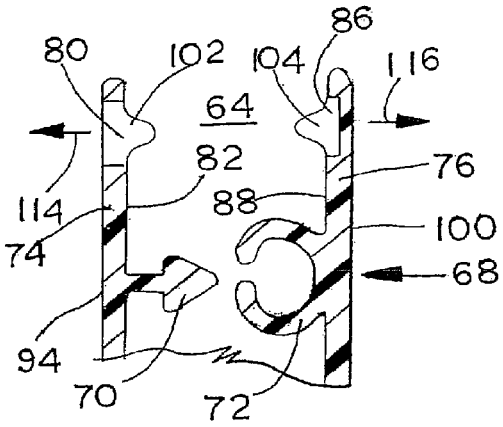
FIG. 2A is a partial cross-sectional view of an aspect of the enhanced closure mechanism, taken generally along the lines 2-2 of FIG. 1.
Figure 2B:
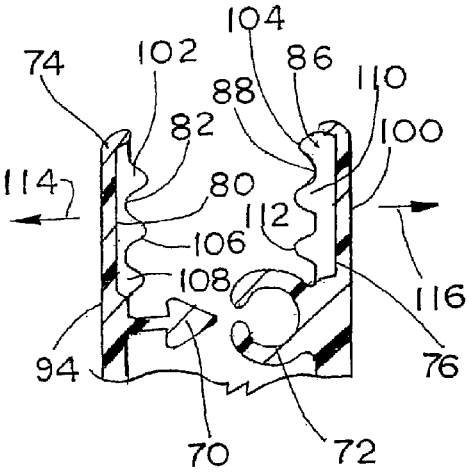
FIG. 2B is a partial cross-sectional view of another aspect of the enhanced closure mechanism, taken generally along the lines 2-2 of FIG. 1.

The closure mechanism 68 illustrated, for example, in FIGS. 2A and 2B includes elongate resealable members that releasably close the mouth together along the along the length of the closure mechanism, such as first and second interlocking members 70, 72 that each has an elongate closure profile disposed across the mouth 64 of the pouch 50 and projects inwardly toward the other interlocking member. The elongate closure profiles of the first and second interlocking members 70, 72 are illustrated as a single male and a single female, respectively, which have substantially constant profiles that resealably interlock along the lengths thereof. However, the closure mechanism 68 of the present invention is not limited to any specific configuration of closure profiles and could include other shapes and/or numbers of closure profiles that would form a seal across the mouth of the pouch. Some exemplary closure mechanisms are illustrated in Pawloski U.S. Pat. No. 7,410,298 and Pawloski et al. U.S. Pat. No. 7,137,736. Other resealable members may include adhesive strips, hook and loop fasteners, and other inter-engaging mechanisms sufficient to releasably close and reclose the mouth 64. Further, the closure mechanism 68 may be integral with or separate and attached to the respective first and second sidewalls 52, 54.

According to one preferred aspect, a first lip or flange 74 has a free end that extends upwardly from the first interlocking member 70, and optionally a second lip or flange 76 has a free end that extends upwardly from the second interlocking member 72. A first line 78 of transverse indentations 80 is formed above the interlocking member 70, for example, by cutting or embossing, into an interior surface 82 of the first flange 74. Optionally, additionally or alternatively, a second line 84 of transverse indentations 86 is formed above the interlocking member 72, for example, by cutting or embossing, into an interior surface 88 of the second flange 76. The first line 78 is substantially parallel to and may be adjacent to or spaced from the first interlocking member 70 and the second line 84 is substantially parallel to and may be adjacent to or spaced from the second interlocking member 72. FIG. 2A illustrates the first and second lines 78, 84 of transverse indentations 80, 86, respectively, spaced from the respective first and second interlocking members 70, 72. FIG. 2B illustrates the first and second lines 78, 84 of transverse indentations 80, 86, respectively, adjacent to the respective first and second interlocking members 70, 72. The transverse indentations 80, 86 may be slits when formed by cutting and may include the removal of material from the flanges 74, 76 or may by cuts made without removal of material.

Figure 2C:
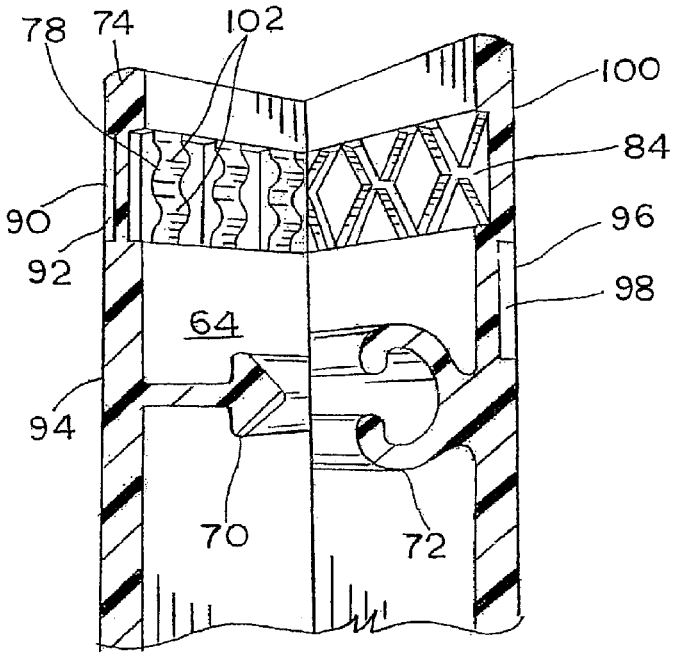
FIG. 2C is a partial cross-sectional view of another aspect of the enhanced closure mechanism, taken generally along the lines 2-2 of FIG. 1.

According to other aspects, shown for example in FIG. 2C, an optional third line 90 of transverse indentations 92 is formed into an exterior surface 94 of the first flange 74 and an optional fourth line 96 of transverse indentations 98 is formed into an exterior surface 100 of the second flange 76. The third line 90 is substantially parallel to and may be adjacent to or spaced from the first interlocking member 70, and the fourth line 96 is substantially parallel to and may be adjacent to or spaced from the second interlocking member 72. The third line 90 and the fourth line 96 may be in addition to the transverse indentations 80, 86, whereby a line of transverse indentations would be disposed on both the interior surfaces 82, 88 and the exterior surfaces 94 and 100, as shown in FIG. 2C, or may be in alternative to the transverse indentations 80, 86, whereby a line of transverse indentations would be disposed only on the exterior surfaces 92, 88 and the interior surfaces would be substantially smooth opposite the third and fourth lines 90 and 96. The third and fourth lines 90 and 96 may be vertically aligned with the respective first and second lines 78 and 84, wherein the third line 90 of indentations is directly opposite the first line 78 of indentations and/or the fourth line 96 of indentations is directly opposite the second line 84 of indentations, or the third and fourth lines 90 and 96 may be vertically offset from the respective first and second lines 78 and 84 of indentations. As shown in FIG. 2C, for example, the third line 90 of indentations 92 is vertically aligned with the first line 78 of indentations located above the interlocking member 79, and the fourth line 96 of indentations 98 is vertically offset and located below the second line 84 of indentations and above the interlocking member 72. The indentations 80, 86, 92, 98 may take various shapes as disclosed herein, for example as shown in FIG. 2C, the indentations 78 are vertically oriented or transverse linear shapes and the indentations 84 are 'X'-shaped having linear sections that are angularly oriented so as to have both a transverse component and a longitudinal component.

The transverse indentations 80, 86 may be formed partially or completely through the respective first and second flanges 74, 76. For example, FIG. 2A illustrates the transverse indentations 80 cut completely through the first flange 74 and the transverse indentations 86 cut partially through the second flange 76. In other embodiments, any or all of the first, second, third, and fourth lines 78, 84, 90, and 96 of transverse indentations 80, 86, 92, and 98, respectively, may be formed into the respective first and second flanges 74, 76 having a depth that varies along the length of the flanges 74, 76, including, for example, portions of the flanges 74, 76 that are partially cut through and portions that are completely cut through.

Figure 3:
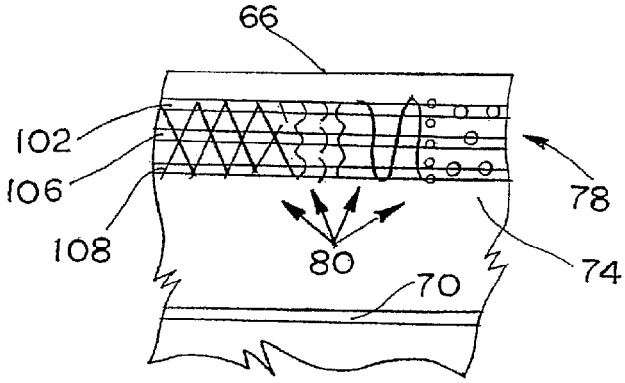
FIG. 3 is an enlarged partial interior side view of the enhanced closure mechanism of FIG. 1.

As best seen in FIG. 3, the transverse indentations 80 that make up the first line 78 may be formed as straight or curvilinear lines into the interior surface 82. Similarly, the transverse indentations 86, 92, 98 that make up the second, third, and fourth lines 84, 90, 96, respectively, may be formed as straight or curvilinear lines. Each line 78, 84, 90, 96 of indentations may itself be linear or curvilinear such that the lines 78 and 90 are substantially (even if not exactly) parallel to the interlocking member 70 and the lines 84 and 96 are substantially (even if not exactly) parallel to the interlocking member 72. Further, the transverse indentations 80, 86, 92, and/or 98 may each include a portion formed at an angle measured relative to the respective lines 78, 84, 90, and/or 96 between about zero degrees and about ninety degrees, such as between about forty degrees and about fifty degrees, which may improve the grasp of a user parallel to the lines 78, 84, 90, and/or 96, perpendicular to the lines 78, 84, 90, and/or 96, and in various directions relative to the lines 78, 84, 90, and/or 96 between parallel and perpendicular thereto. The transverse indentations 80, 86, 92, and/or 98 may also include indicia such as words, logos, or other informational patterns. According to one preferred aspect, a cross-hatch pattern is used for the indentations 80, 86, 92, 98 of one or more of the lines of indentations 78, 84, 90, 96. FIG. 3 illustrates some exemplary possible indentation patterns that may be utilized for the indentations 80, 86, 92, and/or 98.

A double roller mechanism, for example, may be applied to create the indentations 80, 86, 92, 98, wherein the double roller mechanism includes a first roller wheel with cutting or embossing surfaces applied to the surface to be formed and a second roller wheel with a smooth surface of rubber or hard metal, such as steel, applied opposite the first roller wheel on a surface opposite the surface to be formed. In another method, a double roller having complimentary opposing male and female embossing surfaces may be used to create the partial indentations 80, 86, 92, and/or 98.

The transverse indentations 80, 86, 92, 98 may be longitudinally continuous giving the appearance of zero spacing therebetween. Alternatively, spacing between the transverse indentations 80 (and also 86, 92, and 98) may be constant or variable along the first line 78 (and also 84, 90, and 96) and may be selected for aesthetics of the indentation pattern or to facilitate gripping by an average user's fingers. The spacing may be between about 0.02 inch and about 1 inch, preferably between about 0.05 inch and about 0.5 inch, more preferably between about 0.08 inch and about 0.25 inch, and most preferably between about 0.1 inch and about 0.2 inch.

In one preferred embodiment, a first grip strip 102 may be disposed on the interior surface 82 of the first flange 74 and a second grip strip 104 may be disposed on the interior surface 88 of the second flange 76. Each of the first and second grip strips 102, 104 extends away from the respective first and second interior surfaces 82, 88 and facilitates an improved grasp by a user's finger in a direction perpendicular to the grip strip. Other embodiments may include one or more additional grip strips disposed on the interior surfaces 82, 88 of the first and second flanges 74, 76, respectively. For example, FIG. 2B illustrates a third grip strip 106 and a fourth grip strip 108 extending from the interior surface 82 of the first flange 74 and a fifth grip strip 110 and a sixth grip strip 112 extending from the interior surface 88 of the second flange 76. Each of the lines of transverse indentations 78, 84, 90, 96 is disposed coincident with one or more of the grip strips 90, 92, 106, 108, 110, 112. Applying the lines 78, 84, 90, 96 coincident with one or more of the grip strips 90, 92, 106, 108, 110, 112 may further facilitate an improved grasp by a user in a direction parallel to each of the grip strips 90, 92, 106, 108, 110, 112.

In use, the lines 78, 84, 90, 96 of transverse indentations 80, 86, 92, 98 facilitate an improved grasp of the flanges 74, 76 by a user. To open the pouch 50, a user grasps the first flange 74 at the first line 78 of transverse indentations 80 with a first hand and the second flange 76 at the second line 80 of transverse indentations 86 with a second hand. The first and second lines 78, 84 provide a texture on the interior surfaces 82, 88, respectively that minimizes slippage of a user's fingers longitudinally along and transverse to the first and second lines 78, 84. The addition of one or more of the grip strips 90, 92, 106, 108, 110, 112 coincident with the lines 78, 84 further improves the grasp of a user by reducing slippage transverse to the first and second lines 78, 84. Thus grasped, the user pulls the first flange 74 away from the second flange 76 as indicated by the arrows 114, 116 in FIGS. 2A and 2B to forcibly separate the first and second interlocking members 70, 72.

The enhancement to a closure mechanism described hereinabove is compatible with known airtight and/or liquid tight closure mechanisms and improves the grasp of a user in a transverse direction, wet or dry. The enhancement does not require special embossed material and may be manufactured in an inexpensive post-production process.

INDUSTRIAL APPLICABILITY

An enhancement to a closure mechanism that may be used on reclosable thermoplastic pouches has been presented. The enhancement preferably includes a flange that extends upwardly from an interlocking member of the closure mechanism. A line of transverse indentations is formed into the flange generally parallel to the interlocking member. The line of transverse indentations in some instances may facilitate an improved grip of the flange by a user to simplify opening of the closure mechanism.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive right to all modifications within the scope of the impending claims is expressly reserved. All patents, patent publications and applications, and other references cited herein are incorporated by reference herein in their entirety.

We claim:

1. An enhancement to a closure mechanism comprising:

an interlocking member having an elongate profile projecting from an interior surface of the closure mechanism and extending longitudinally between opposite ends of the closure mechanism;

a flange having an elongate profile projecting upwardly from the interlocking member and extending between opposite ends of the closure mechanism;

a line of transverse indentations formed into an interior surface of the flange, wherein the line of transverse indentations is disposed substantially parallel to and extends along the entire elongate profile of the interlocking member, and spacing between the transverse indentations in the line is about 0.1 to about 0.2 inches; and a line of transverse indentations formed into an exterior surface of the flange, wherein the line of transverse indentations formed into the exterior surface of the flange is disposed above and substantially parallel to and extends along the entire elongate profile of the interlocking member.

2. The enhancement to a closure mechanism of claim 1, wherein the transverse indentations formed into the interior surface of the flange comprise slits in the flange that extend only part way through the flange.

3. The enhancement to a closure mechanism of claim 1, wherein the interlocking member is a first interlocking member, wherein the closure mechanism further comprises a second interlocking member having an elongate profile extending longitudinally between the opposite ends of the closure mechanism, the second interlocking member having a flange extending upwardly therefrom, and wherein the second interlocking member resealably interlocks with the first interlocking member along the length of the closure mechanism.

4. The enhancement to a closure mechanism of claim 3, further comprising at least one grip strip disposed on the interior surface of the flange projecting upwardly from the first interlocking member, with the at least one grip strip being coincident with the line of transverse indentations formed into the interior surface of the flange projecting upwardly from the first interlocking member.

5. The enhancement to a closure mechanism of claim 4, further comprising at least one grip strip disposed (i) on an interior surface of the flange projecting upwardly from the second interlocking member, and (b) substantially parallel to and spaced from the second interlocking member.

6. The enhancement to a closure mechanism of claim 3, further comprising a line of transverse indentations formed into an interior surface of the flange projecting upwardly from the second interlocking member, wherein the line of transverse indentations formed into the interior surface of the flange projecting upwardly from the second interlocking member is substantially parallel to the second interlocking member.

7. The enhancement to a closure mechanism of claim 6, further comprising at least one grip strip disposed on the interior surface of the flange projecting upwardly from the first interlocking member.

8. The enhancement to a closure mechanism of claim 1, wherein the transverse indentations formed into the interior surface of the flange comprise slits that extend completely through the flange.

9. A reclosable pouch comprising:

a closure mechanism having first and second elongate resealable members having elongate profiles and disposed longitudinally across opposing interior surfaces of a mouth of the pouch;

a flange extending transversely upwardly from the first elongate resealable member away from an interior of the pouch; and a line of transverse indentations formed into an interior surface of the flange, wherein the line of transverse indentations is substantially parallel to and extends along the entire elongate profile of the first elongate resealable member, and spacing between the transverse indentations is about 0.1 to about 0.2 inches; and a line of transverse indentations formed into an exterior surface of the flange, wherein the line of transverse indentations formed into the exterior surface of the flange is disposed above and substantially parallel to and extends along the entire elongate profile of the first elongate resealable member.

10. The reclosable pouch of claim 9, further comprising a grip strip disposed on the interior surface of the flange coincident with the line of transverse indentations formed into the interior surface of the flange.

11. The reclosable pouch of claim 9, further comprising a flange extending transversely upwardly from the second elongate resealable member.

12. The reclosable pouch of claim 11, further comprising a grip strip disposed on the interior surface of the flange extending transversely upwardly from the first elongate resealable member.

13. The reclosable pouch of claim 12, further comprising a grip strip disposed (i) on an interior surface of the flange extending upwardly from the second elongate resealable member, and (ii) substantially parallel to and spaced from the second elongate resealable member.

14. The reclosable pouch of claim 11, further comprising a line of transverse indentations formed into an interior surface of the flange extending upwardly from the second elongate resealable member, wherein the line of transverse indentations formed into the interior surface of the flange extending upwardly from the second elongate resealable member is substantially parallel to the second elongate resealable member.

15. The reclosable pouch of claim 9, wherein the first and second resealable members comprise elongate interlocking profiles that extend from one end of the closure mechanism to the other end of the closure mechanism.

16. The reclosable pouch of claim 9, wherein the transverse indentations formed into the interior surface of the flange comprise slits that extend completely through the flange.

17. A method of opening a resealable closure mechanism on a pouch, the method comprising the steps of:

(a) providing a pouch comprising:

(i) a closure mechanism that includes first and second interlocking members having elongate profiles disposed longitudinally across a mouth of the pouch;

(ii) a flange extending transversely upwardly from the first interlocking member;

(iii) a flange extending transversely upwardly from the second interlocking member;

(iv) a line of transverse indentations formed into an interior surface of the flange extending transversely upwardly from the first interlocking member, wherein the line of transverse indentations is substantially parallel to and extends along the entire elongate profile of the first interlocking member, and spacing between the transverse indentations is about 0.1 to about 0.2 inches; and (v) a line of transverse indentations formed into an exterior surface of the flange extending transversely upwardly from the first interlocking member, wherein the line of transverse indentations formed into the exterior surface of the flange is disposed above and substantially parallel to and extends along the entire elongate profile of the first interlocking member;

(b) grasping the flange extending transversely upwardly from the first interlocking member with a first hand at the line of transverse indentations;

(c) grasping the flange extending transversely upwardly from the second interlocking member with a second hand; and (d) pulling the flange extending transversely upwardly from the first interlocking member away from the flange extending transversely upwardly from the second interlocking member to forcibly separate the first and second interlocking members.

18. The method of opening a resealable closure mechanism on a pouch of claim 17, wherein the flange extending transversely upwardly from the first interlocking member further includes a grip strip disposed on the interior surface thereof coincident with the line of transverse indentations, and wherein the step of grasping the flange extending transversely upwardly from the first interlocking member comprises grasping the flange with a first hand at the grip strip.

19. The method of opening a resealable closure mechanism on a pouch of claim 18, wherein the flange extending transversely upwardly from the second interlocking member further includes a line of transverse indentations formed into an interior surface thereof, wherein the line of transverse indentations formed into the interior surface of the flange extending transversely upwardly from the second interlocking member is substantially parallel to the second interlocking member, and wherein the step of grasping the flange extending transversely upwardly from the second interlocking member comprises grasping the flange with the second hand at the line of transverse indentations formed into the interior surface of the flange extending transversely upwardly from the second interlocking member.

20. The method of opening a resealable closure mechanism on a pouch of claim 19, wherein the flange extending transversely upwardly from the second interlocking member further includes a grip strip disposed on the interior surface thereof coincident with the line of transverse indentations formed into the interior surface of the flange extending transversely upwardly from the second interlocking member, and wherein the step of grasping the flange extending transversely upwardly from the second interlocking member comprises grasping the flange with a second hand at the grip strip.

* * * * *